United States Patent [19]

Congram et al.

[11] 4,164,927

[45] Aug. 21, 1979

[54] REINFORCED STAMPED VALVE COVER

[75] Inventors: Sam R. Congram, Peoria, Ill.; George S. Cole, Laddonia, Mo.

[73] Assignee: Caterpillar Tractor Co., Peoria, Ill.

[21] Appl. No.: 816,580

[22] Filed: Jul. 18, 1977

[51] Int. Cl.[2] ..... F01M 9/10

[52] U.S. Cl. ..... 123/195 C; 123/90.38; 220/327

[58] Field of Search ..... 123/195 R, 195 C, 90.37, 123/90.38; 220/327, 328, 378

[56] References Cited

U.S. PATENT DOCUMENTS

| | | | |
|---|---|---|---|
| 2,427,288 | 9/1947 | Kraker | 123/90.38 |
| 3,090,463 | 5/1963 | Yanda | 123/195 C |
| 3,869,859 | 3/1975 | Thornburgh | 123/195 C |

*Primary Examiner*—Ronald H. Lazarus
*Assistant Examiner*—Craig R. Feinberg
*Attorney, Agent, or Firm*—Wegner, Stellman, McCord, Wiles & Wood

[57] ABSTRACT

A reinforced stamped valve cover including an elongated housing having a trough-like configuration including an elongated base wall, a pair of spaced, elongated side walls attached to and extending from one side of the base wall, and a pair of spaced, relatively short end walls extending from the base wall and adjoining the end walls. The walls are stamped from a single sheet of metal and are provided with an outwardly directed ledge substantially surrounded by a peripheral flange. A pair of spaced, U-shaped strengthening members are disposed within the housing with each having a bight and a pair of legs extending therefrom. Each bight is configured to substantially conform to the base wall and is in substantial abutment therewith. Each leg abuts a corresponding one of the side walls along substantially the entire extension thereof from the base wall and past the ledge to define with the flange a gasket-receiving pocket. The legs are configured to conform to the corresponding side wall and the strengthening members are secured in spaced relation to the housing.

2 Claims, 2 Drawing Figures

REINFORCED STAMPED VALVE COVER

BACKGROUND OF THE INVENTION

This invention relates to valve covers for reciprocating engines or the like.

Stamped metal valve covers have long been used in connection with reciprocating, internal combustion engines having overhead valves. Because they house moving components of the engine, it is necessary that they be made with sufficient strength so that they cannot be bent inwardly into interference relation with push rods, rocker arms, valves, or other moving components housed thereby. In addition, they must be sealed to the head of the engine to prevent undue lubricant leakage from the moving parts from exiting through the interface of the head and the valve cover.

In prior art constructions, strengthening elements have been disposed within the housing defining the major part of the valve cover and, in general, the same have been U-shaped with the bight in abutment with the base wall of the housing and the legs extending partially along the side walls of the housing. However, due to the fact that the legs extend only partially along the extension of the side walls from the base wall, the application of a force to the base wall substantially normal thereto can cause collapse of the side walls in the areas where they are not reinforced.

Moreover, in order to provide for adequate sealing of such valve covers to engine heads, it has been necessary to secure, as by welding, a peripheral, internal flange which, together with an outwardly projecting ledge also surrounded by a flange, define a gasket-receiving pocket. The pocket is, of course, necessary to properly locate the gasket to ensure adequate sealing, but the need for the first-mentioned peripheral flange requires the addition of a separate part to the completed valve cover and the attendant expense of labor in providing the same.

SUMMARY OF THE INVENTION

The present invention is directed to overcoming one or more of the above problems.

According to the present invention, there is provided a valve cover defined by an elongated housing having a trough-like configuration including an elongated base wall, a pair of spaced, elongated side walls attached to and extending from one side of the base wall, and a pair of spaced, relatively short end walls extending from the base wall one side and joining the end walls. The various walls are stamped from a single sheet of metal and a pair of spaced, U-shaped strengthening members are disposed within the housing. Each strengthening member includes a bight and a pair of legs extending therefrom with each bight being configured to substantially conform to the base wall one side and be in substantial abutment therewith. Each leg abuts a corresponding one of the side walls along substantially the entire extension thereof from the base wall and is configured to substantially conform thereto. Means are provided for securing the strengthening members in spaced relation to the housing.

Other objects and advantages will become apparent from the following specification taken in connection with the accompanying drawings.

DESCRIPTION OF THE PREFERRED EMBODIMENT

Figure 1:
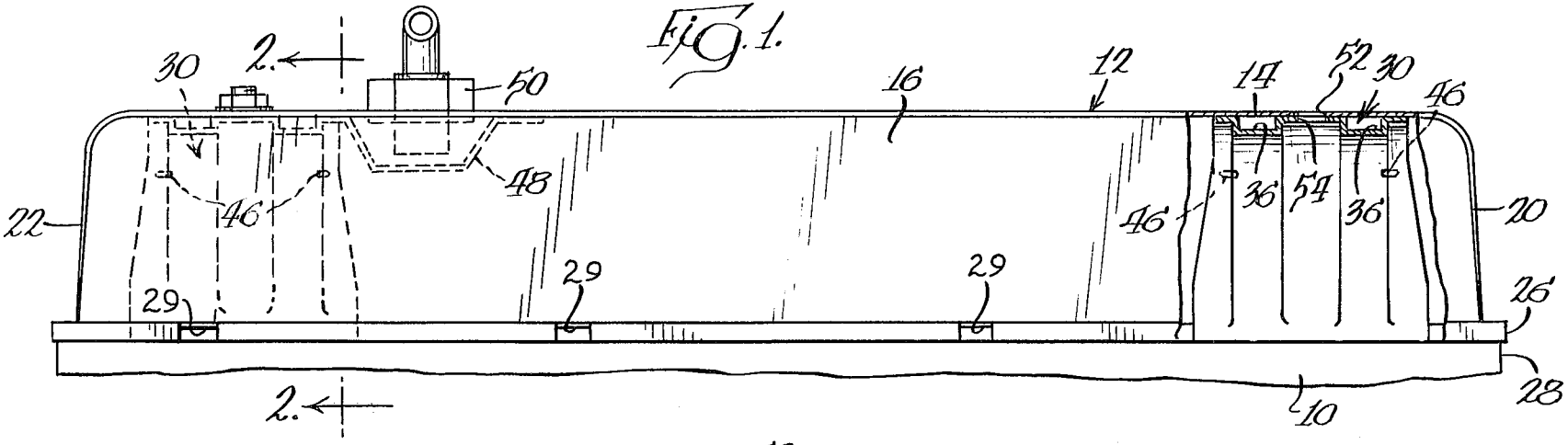
FIG. 1 is a side elevation of a valve cover made according to the invention partially secured to the head of a reciprocating, internal combustion engine with parts shown in section for clarity.

An exemplary embodiment of a valve cover made according to the invention is illustrated in the drawings and with reference thereto, is seen to be mounted on the head 10 of a reciprocating, internal combustion, overhead valve engine. The valve cover includes a housing, generally designated 12, having a trough-like configuration and including an elongated base wall 14. A pair of elongated, spaced side walls 16 and 18 extend from one side of the base wall 14 while a pair of relatively short, spaced end walls 20 and 22 also extend from the same side of the base wall 14 and join the end walls 16 and 18. Each of the walls 14, 16, 18, 20 and 22 are stamped from a single sheet of metal.

Figure 2:
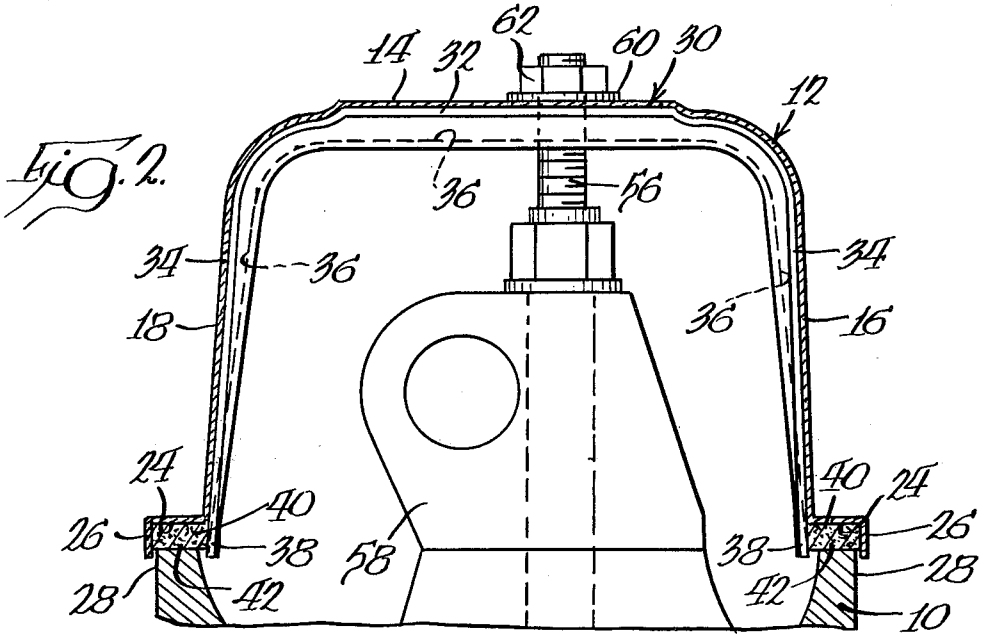
FIG. 2 is a vertical section taken approximately along the line 2—2 in FIG. 1.

The ends of the side walls 16 and 18 and the end walls 20 and 22 remote from the base wall 14 terminate in an outwardly directed ledge 24 which is peripheral and which itself is bounded by a peripheral flange 26. The ledge 24 is generally parallel to the base wall 14, while the flange 26 is generally parallel to the side and end walls 16–22. As seen in FIG. 2, the flange 26 is adapted to be disposed about the border 28 of the head 10. As seen in FIG. 1, notches 29 may be located in the flange 26 at various locations for purposes to be seen.

Adjacent opposite ends 20 and 22 of the valve cover, there are located strengthening members, each generally designated 30. As seen in FIG. 2, each strengthening member is generally U-shaped and includes a bight 32 in abutment with the base wall 14 and configured to substantially conform thereto. Legs 34 extend from the bight 32 and are configured to substantially conform to corresponding ones of the side walls 16 and 18. In addition, the legs 34 extend along substantially the entire extension of each side wall 16 and 18 from the base wall 14.

Preferably, each strengthening member 30 is provided with an integral, stamped channel configuration 36. As seen in FIG. 1, two such channel configurations 36 are located in each strengthening member 30 and, as can be ascertained from FIGS. 1 and 2, each extends across the bight 32 and into both of the legs 34, substantially the full extent of the latter.

As best seen in FIG. 2, each leg 34 extends, as at 38, past the ledge 24 so as to define a pocket 40 for receipt of a gasket 42. The gasket 42 seals the interface of the valve cover with the upper boundary 28 of the head 10. The presence of the pockets 40, there being one such pocket at each of the legs 34 for a total of four in all in the embodiment illustrated, serves to properly locate the gasket 42 for proper sealing disposition between the cover and the head 10. Where desired, the gasket 42 may be provided with tabs (not shown) which extend through the notches 29 in the flange 26 to further assist in properly locating the gasket 42 at positions slightly remote from the strengthening members 30.

The strengthening members 30 are secured to the cover as by welds 46 in the legs 34 to the side walls 16 and 18.

The base wall 12 may be provided with a welded strip baffle and opening construction 48 for baffling and mounting a PCV valve. In addition, apertures 52 at opposite ends of the base wall 14 may be provided and are aligned with apertures 54 in the bight 32 of each strengthening member 30. A threaded stud 56, secured in any suitable fashion as to a rocker arm shaft mount 58 secured to the block 10, extends upwardly from the head 10 in alignment with each of the apertures 52 to receive a washer 60 and a securing nut 62 whereby the valve cover may be secured to the head 10 in sealed relation thereto. The channel configurations 36 are located, one on each side of the aperture 54, to provide symmetrical reinforcing when the stud 56 is tightened.

From the foregoing, it will be appreciated that by reason of the full length extension of the legs 34 of the strengthening members 30, the side walls 16 and 18 are strengthened from top to bottom and therefore are not subject to collapse as in prior art constructions. In addition, by reason of the extension of the legs 34 past the ledge 24 to define the pockets 40, the need for a separate retaining flange interiorly of the flange 26 is omitted, thereby omitting the need for an additional part and the labor required to install the same in place. It will be noted from FIG. 1 that the legs 34 flare slightly from top to bottom to increase the length of the pocket 40 for this purpose. Thus, not only do the strengthening members 30 of the present invention provide improved strength over those used in the prior art, but the same also eliminate the need for a gasket retaining flange heretofore required while retaining the function of the latter.

The embodiments of the invention in which an exclusive property or privilege is claimed are defined as follows:

1. A valve cover comprising:

an elongated housing having a trough-like configuration including an elongated base wall, a pair of spaced, elongated side walls attached to and extending from one side of said base wall, and a pair of spaced, relatively short end walls extending from said base wall one side and joining said end walls, said walls being stamped from a single sheet of metal, with the ends of said side and end walls terminating in an outwardly directed ledge having a peripheral flange directed away from said base wall and substantially surrounding said ledge, said flange being generally parallel to said side and end walls;

a pair of spaced, U-shaped strengthening members disposed within said housing, each having a bight and a pair of legs extending therefrom, each said bight being configured to substantially conform to said base wall one side and being in abutment therewith, each said leg abutting a corresponding one of said walls along substantially the entire extension thereof from said base wall and past said ledge to define, with said flange, a gasket receiving pocket opening away from said base wall; and means securing said strengthening members, in spaced relation, to said housing.

2. A valve cover as set forth in claim 1 wherein each said strengthening member is formed with two spaced channel formations, each extending across the bight and into both legs a substantial distance.

* * * * *